US009011308B2

(12) United States Patent
Treccani et al.

(10) Patent No.: US 9,011,308 B2
(45) Date of Patent: Apr. 21, 2015

(54) EQUIPMENT AND METHOD FOR THE FORMING OF PAPER CONTAINERS

(75) Inventors: Giuseppe Treccani, Capriano del Colle (IT); Mauro Leali, Capriano del Colle (IT)

(73) Assignee: Quality Tools S.r.l., Capriano del Colle (Brescia) (IT)

( * ) Notice: Subject to any disclaimer, the term of this patent is extended or adjusted under 35 U.S.C. 154(b) by 876 days.

(21) Appl. No.: 13/123,416

(22) PCT Filed: Oct. 7, 2009

(86) PCT No.: PCT/IT2009/000453

§ 371 (c)(1),
(2), (4) Date: Apr. 8, 2011

(87) PCT Pub. No.: WO2010/044117

PCT Pub. Date: Apr. 22, 2010

(65) Prior Publication Data

US 2011/0195829 A1 Aug. 11, 2011

(30) Foreign Application Priority Data

Oct. 16, 2008 (IT) ..... BS2008A0183

(51) Int. Cl.
*B31B 43/00* (2006.01)
*B31F 1/00* (2006.01)
*B31B 45/00* (2006.01)

(52) U.S. Cl.
CPC ..... *B31F 1/0077* (2013.01); *B31B 43/00* (2013.01); *B31B 45/00* (2013.01); *B31B 2201/223* (2013.01); *B31B 2201/2654* (2013.01); *B31B 2201/2695* (2013.01); *B31B 2203/00* (2013.01)

(58) Field of Classification Search
CPC .. B31B 43/00; B31B 3/00; B31B 2201/2654; B65D 5/4266
USPC ..... 493/174, 152, 158, 167, 227, 239, 59, 493/61–62, 73–74, 79, 84–86, 185
See application file for complete search history.

(56) References Cited

U.S. PATENT DOCUMENTS 4,295,839 A * 10/1981 Baker et al. ..... 493/143
6,093,460 A 7/2000 Iwaya
6,106,453 A * 8/2000 Sinn et al. ..... 493/473

FOREIGN PATENT DOCUMENTS

EP 0 951 990 A2 10/1999

*Primary Examiner* — Thanh Truong
*Assistant Examiner* — Tara M Ho
(74) *Attorney, Agent, or Firm* — McGlew and Tuttle, P.C.

(57) ABSTRACT

The invention concerns the equipment for forming of paper containers starting from a continuous wet paper belt. It comprises a mobile semi-mold and a fixed semi-mold defining an impression corresponding to the container to be produced. Around the mobile semi-mold (15) are provided concentrically an upper cutting blade (18), an upper pleating/crimping ring (19) and an upper rim former (20); around the fixed semi-mold (14) are provided a counter cutting blade (21), an upper counter pleating/crimping ring (22) and a counter rim former (23), associated respectively with the cutting blade, the pleating/crimping ring and rim former on board associated with a mobile semi-mold. And this, respectively, to cut from the initial paper tape a length of paper depending on the measurements of the container to be formed, to pleat/crimp a peripheral crown of said blank paper during the closing stroke of the semi-molds, and to form a crimped rim around the lateral wall of the container during the opening stroke of said semi-molds.

20 Claims, 7 Drawing Sheets

EQUIPMENT AND METHOD FOR THE FORMING OF PAPER CONTAINERS

FIELD OF THE INVENTION

The invention refers to equipment to be used with presses for the forming of paper containers provided with a curled peripheral rim. The invention is also concerns a method for the forming of containers with such equipment, meaning here by "containers", trays and circular or non circular tubs made out of a "papery material", both vellum paper (VP) and paper using several layers or siliconed, also with a weight of less than about 220 g/m$^2$.

STATE OF THE TECHNIQUE

On the one hand the document U.S. Pat. No. 6,093,460 is indicative of the state of the technique. That document describes a machine and a method for forming the so-called basically rectangular paper containers, starting however from a pre-cut initial intermediate forging not carried out by the machine, but in a previous work station, and using explicitly card with a relatively high weight (from 200 to 400 g/m$^2$) and covered by a resin film both on all its front and rear surfaces.

In other words, the container, therefore, is not made, as they say, "all in one go", but in successive and separate phases: first with equipment for cutting the initial roughing card, then with the equipment for forming the container starting from the pre-established roughing card with considerable down time and equipment costs.

Furthermore, also not expressly described, the machine represented in the abovementioned document is purely mechanical and as such it does not appear to be suitable for carrying out diversified strokes for the realization of different work, especially if in the presence of damp paper.

In contrast, in a previous application for a patent by the same applicant a press for forming containers, trays or tubs starting from a sheet of damp paper was described which comprised a fixed mould holder table with a lower semi-mould and a movable mould holder table with a upper semi-mould movable as regards to the fixed table between an opening position and a closed position of the mould and whose characteristics are in the fact that the movable mould holder table is operated by a basically electric actuator and the semi-moulds are provided with heating means for drying the wet starting paper and its stiffening in a given closed position, that is before the mould begins to open. Therefore, in this press, the forward and backward strokes of the mobile table, that is to say the closing and opening of the mould can be programmed, run, finely adjusted, slowed down or stopped according to needs during the forming cycle of each manufactured article.

OBJECTIVE OF THE INVENTION

Starting from these introductory statements, the main objective of this invention is to propose equipment and a method for the forming of paper containers really "all in one go", from the cutting of an initial roughing by a continuous paper tape, to the forming of the container and to the finishing of its peripheral rim carried out directly and completely by the same machine.

In this way, the advantages are gained of being able to eliminate the necessity of having available and having to manage additional or auxiliary equipment and of being able to produce one or more complete and finished container (depending on the impressions of the mould) at each operating cycle on the opening and closing of the mould, and save on down time by increasing at the same time the productivity of the forming system.

The objective and the advantages are reached in agreement with the invention with equipment according to the preamble in claim 1 and in which around the semi-mould on board the movable mould holder table are provided con centrically a upper cutting blade, an upper pleating/crimping ring and an upper rim former, and in which around the fixed semi-mould are provided a counter cutting blade, a counter upper pleating/crimping ring and an upper rim former, associated respectively with the upper cutting blade, the pleating/crimping ring and the rim former on board associated with the mobile semi-mould, the blade and the counter cutting blade being provided to cut a length from the initial paper tape depending on the dimensions of the container to be formed, the pleating/crimping ring and counter ring being designed to pleat/crimp a peripheral crown of said rough paper during the closing stroke of the semi-moulds, whereas the rim former and the counter rim former are provided to form a crimped rim around the lateral wall of the container during the opening stroke of said semi-moulds.

The invention also concerns a method for the forming of a paper container, tray or tub according to claim 9.

BRIEF DESCRIPTION OF THE DRAWINGS

The invention will however be illustrated in greater detail in the following description carried out in reference to the enclosed indicative and not limitative drawings, in which.

DETAILED DESCRIPTION OF THE INVENTION

Figure 1:
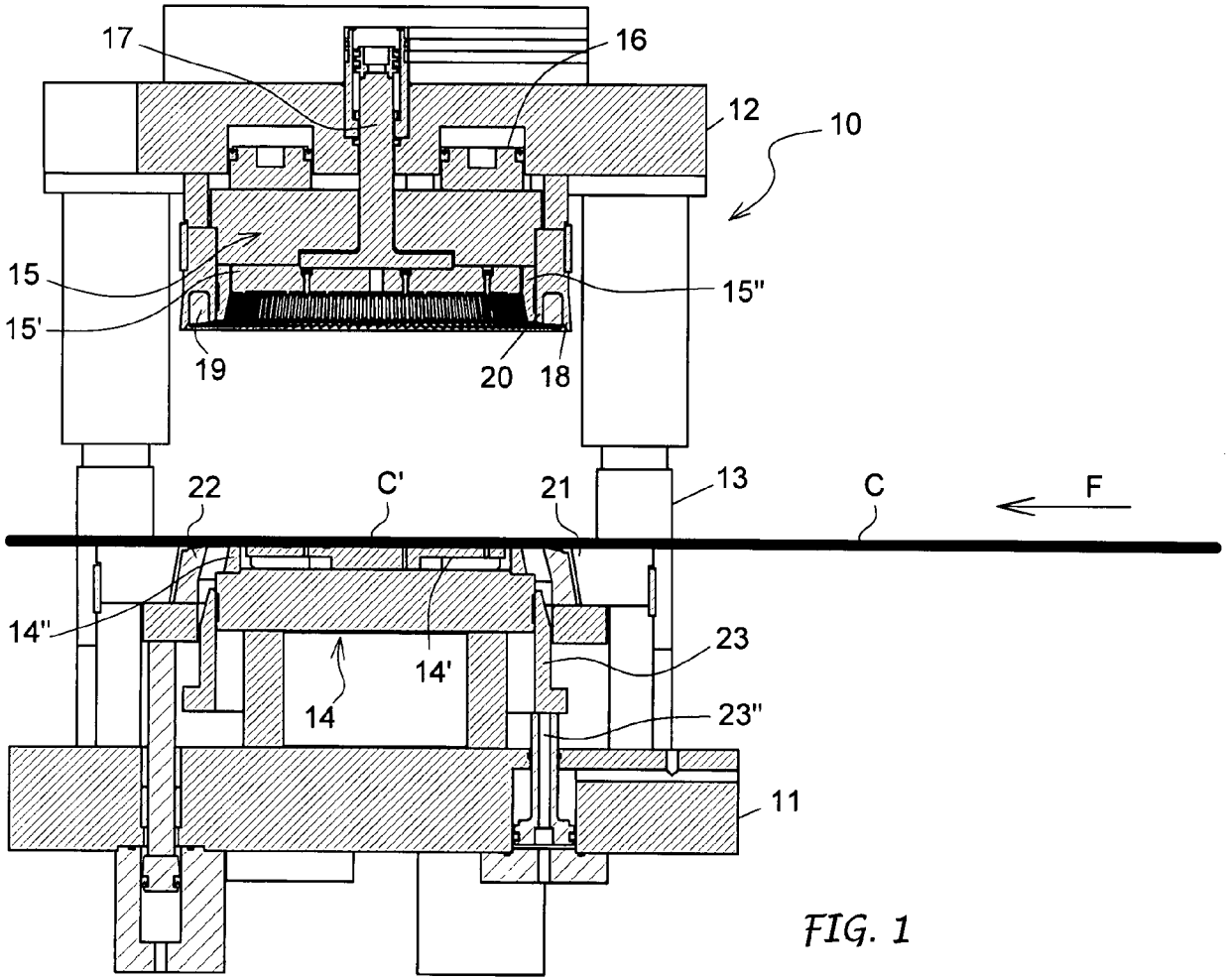
FIG. 1 shows a view in cross section of the equipment in an open mould starting position waiting for a paper tape to be loaded.

In said drawings, the equipment for the forming of paper containers of the type referred to above and globally indicated by 10, is usable with a press, in particular, but not exclusively, of the type described in the above application for a patent by the same applicant and can be fed with a continuous paper tape C according to the F arrows in FIG. 1.

The equipment 10 basically comprises a fixed semi-mould holder lower table 11 and an upper mould holder table 12, the latter movable along guide columns 13 above the fixed table. From time to time the fixed mould holder table 11 is attached to a lower semi-mould 14, whereas the mobile mould holder table 12 becomes attached to an upper semi-mould 15 with the interposition of a shock absorber bearing 16, the two semi-moulds 14, 15 defining complementarily at least an imprint corresponding, in shape and dimensions, to the container 100 to be made.

The initial paper C is wetted according to the requirements and the components 14, 15 of the mould are conveniently heated to heat the wet paper and to dry it in a given phase of the forming cycle of the required container.

The mobile mould holder table 12 is movable between two end positions: one opening position, in which the upper semi-mould 15 is at a distance from the lower semi-mould 14 on the fixed mould holder table, and a closed position, in which the upper semi-mould is moved towards and joins with the lower semi-mould.

The fixed lower semi-mould 14, comprises a lower drawing plate 14' surrounded by a relative drawing punch 14". Analogously, the upper mobile semi-mould 15, comprises an upper drawing plate 15' surrounded by a relative drawing matrix 15", where however the upper drawing plate 15' can move axially with regard to the matrix 15" by means of a pneumatic thruster 17. Substantially, the imprint corresponds to the container 100 to be made is defined by the upper drawing plate with the relative drawing matrix and lower drawing plate with the relative drawing punch.

When the equipment 10 is designed for the forming of circular containers as in the example shown, on board the mobile mold supporting table 12, around the upper semi-mold 15, and movable together with the present one, are provided, radially on the outside, at different levels and facing towards the fixed mold holder plane: an upper cutting blade 18, an upper pleating/crimping ring 19 and an upper rim former 20, where preferably the cutting blade and the rim former are part of a single component and the pleating/crimping ring is positioned between said blade and said rim former.

On the fixed mould holder table 11 are provided a counter cutting blade 21, a counter pleating/crimping ring 22 and a counter rim former 23, respectively associated with the cutting blade 18, the pleating/crimping ring 19 and the rim former 20 on board the movable mould holder. In particular, the counter rim former 23 has a rounded groove 23' facing towards the rim former 20 and is movable in height with regard to the latter by means of a respective control system 23".

Figure 6A:
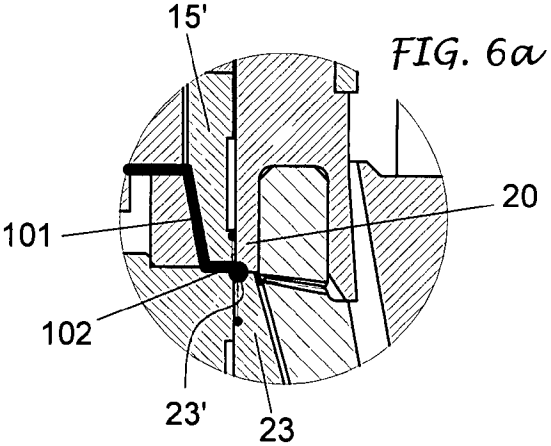
FIG. 6*a* shows an enlarged view of the circled detail in FIG. 6.
Figure 6B:
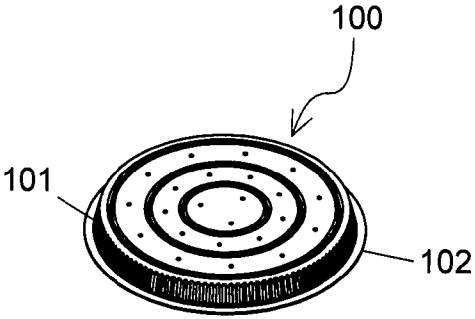
FIG. 6*b* shows a view of the container complete with peripheral rim.
Figure 6:
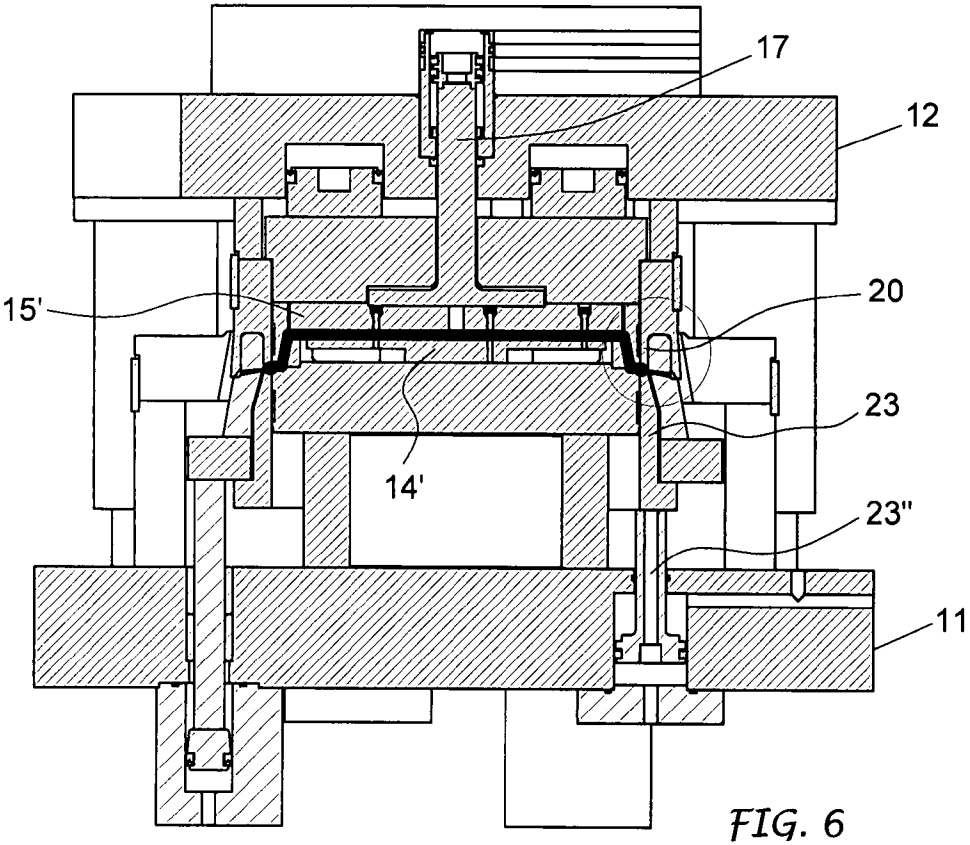
FIG. 6 shows a view of the equipment with mould in a partially open position for the formation of the peripheral rim of the container.

With the equipment described above for each of its operating cycles the forming of a paper container 100 is produced with the required and with a lateral wall 101 finishing with an curled peripheral rim 102, basically toric—FIG. 6*b*.

At the start of the cycle, the mould is open as shown in FIG. 1, in a position to be able to feed a stretch C' of the initial paper tape C, in length depending on the dimensions of the container to be produced. Typically the paper will be conveniently wetted.

Figure 2A:
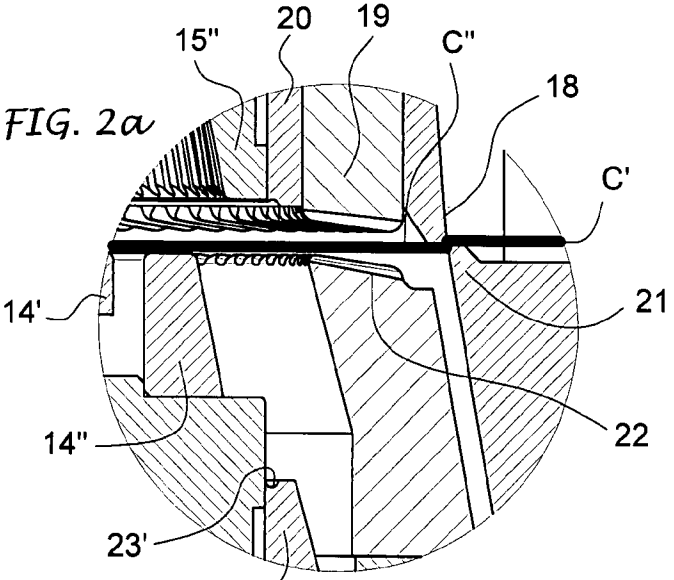
FIG. 2*a* shows an enlarged view of the circled detail in FIG. 2.
Figure 2B:
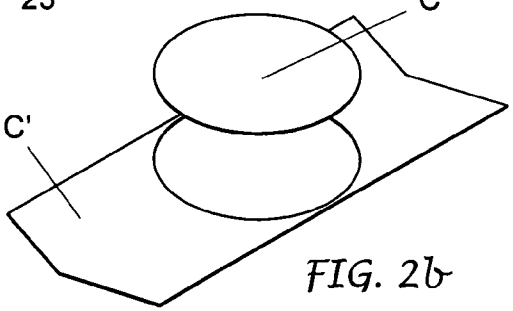
FIG. 2*b* shows a view of a length of paper cut from the initial tape for forming a container, in the case in question circular.
Figure 2:
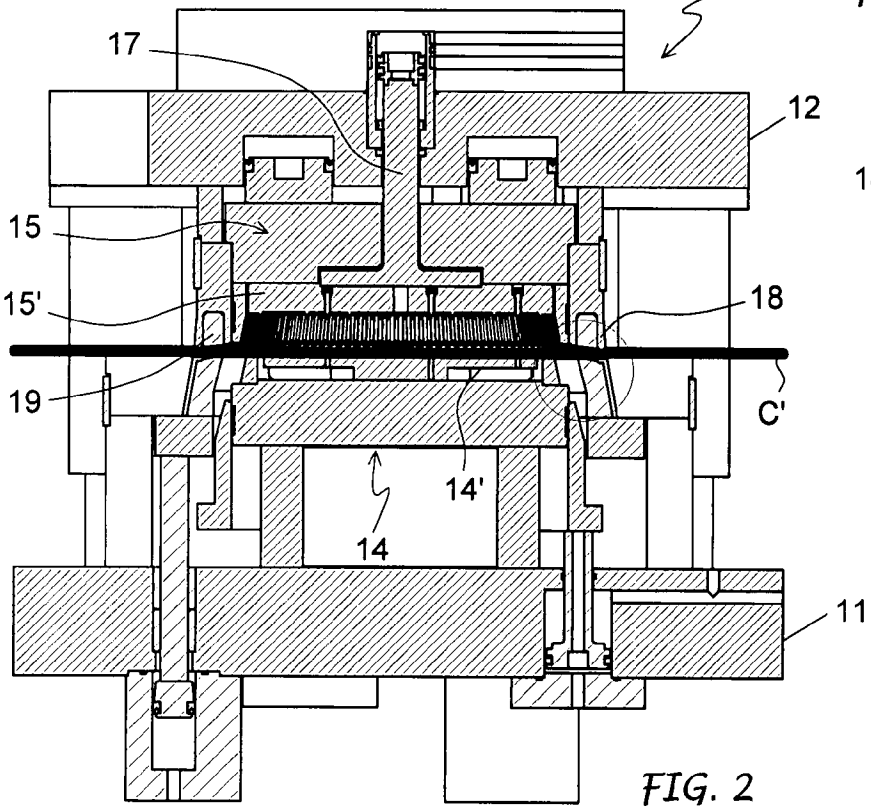
FIG. 2 shows an analogous view of the equipment but with the mould in a first closed position for a cutting/dinking operation of a length of paper tape.

The closing of the mold now starts, which after partially closing to about two thirds of its total stroke, causes, on a level with the blade 18 and counter blade 21, the cutting of a length of paper C' from a blank roll C" compatible with the dimensions of the container to be produced as shown in FIGS. 2, 2*a* and 2*b*. As regards to this it should be noted that the shearing of the blank roll C" may also be carried out by dinking, with the aid of a hand punch and a relative counterpart—not shown.

Figure 3A:
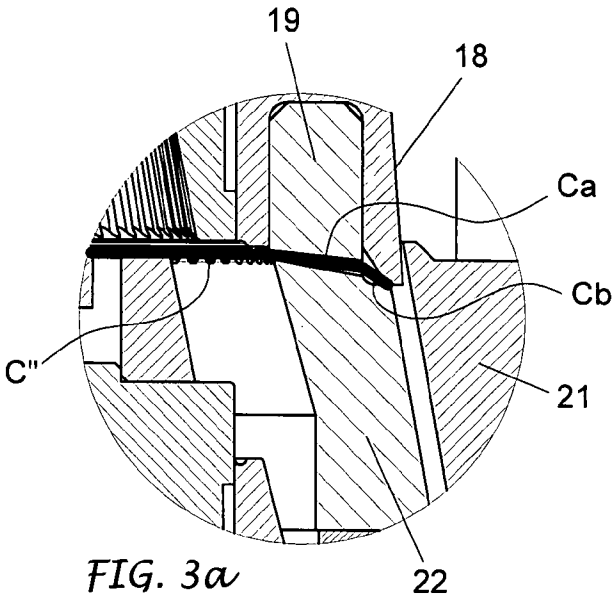
FIG. 3*a* shows an enlarged view of the circled detail in FIG. 3.
Figure 3B:
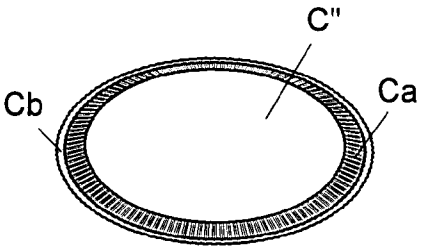
FIG. 3*b* shows a view of the length of paper after its first treatment.
Figure 3:
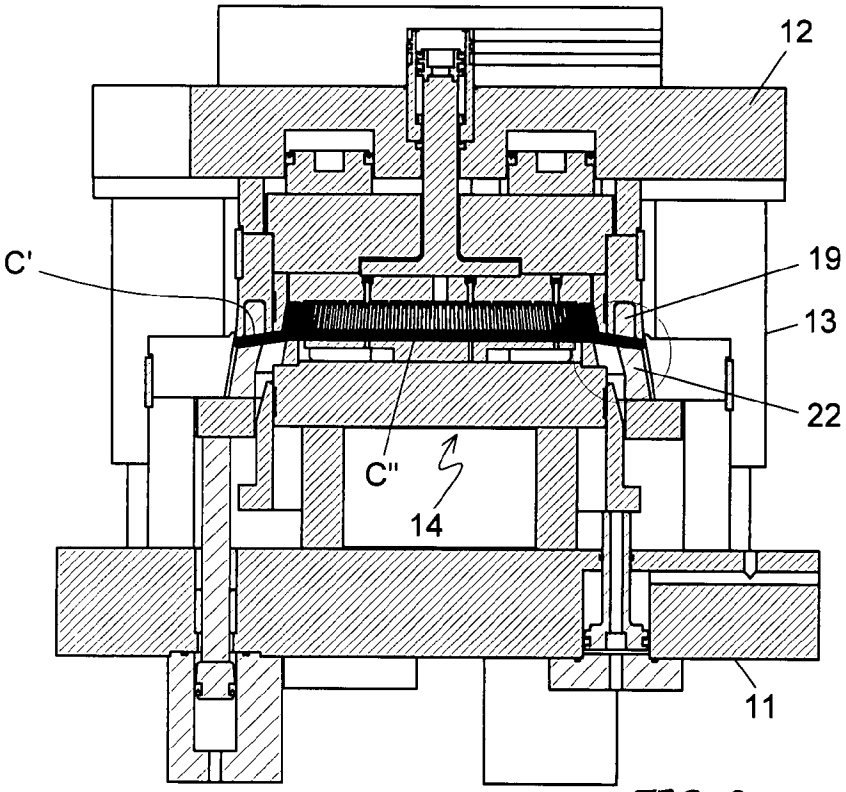
FIG. 3 shows a view of the equipment with mould in a second closed position for a first peripheral treatment of the length of paper cut previously.

The closing of the mould continues then for a further brief length of its stroke so as to cause both a grip on a peripheral crown Ca of the blank roll C" and the start of a pleating of said peripheral crown between the ring 19 and the pleating counter ring 22, excluding a marginal portion Cb, as shown in FIGS. 3 and 3*a*. Viewed on its own, the blank C" will then have the configuration as shown in FIG. 3*b*.

Hence the closing of the mould continues further in proportion to the depth of the container to be produced.

Figure 4A:
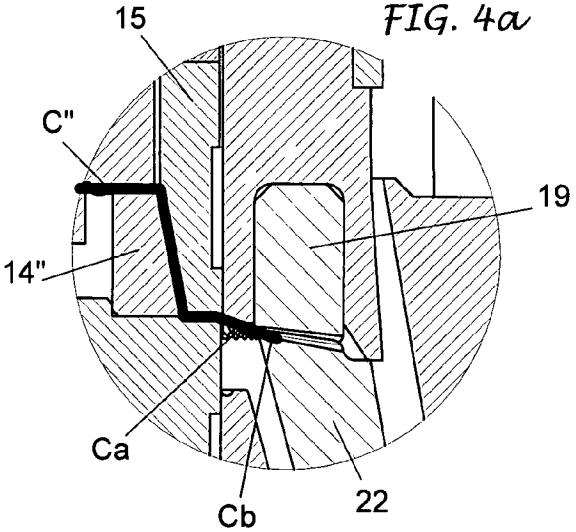
FIG. 4*a* shows an enlarged view of the circled detail in FIG. 4.
Figure 4B:
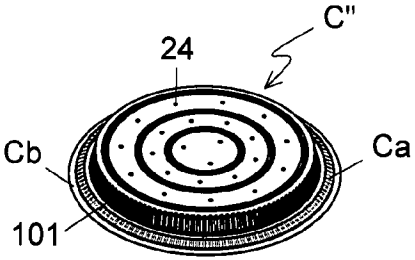
FIG. 4*b* shows a view of the container after drawing.
Figure 4:
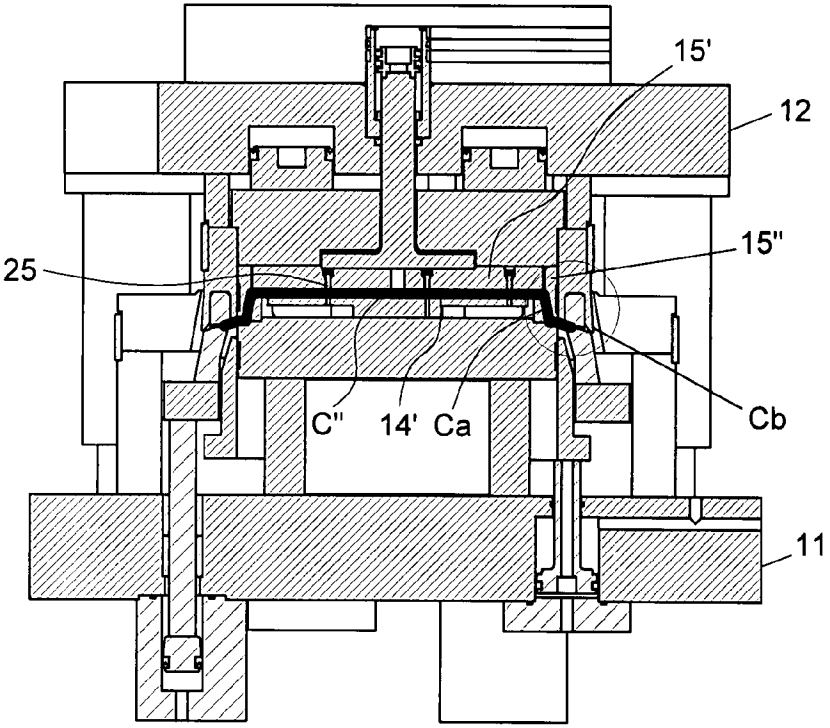
FIG. 4 shows a view of the equipment with mould in a further closed position for a drawing operation of the length of paper and moulding of a container.

Therefore the pleating of the peripheral crown Ca proceeds and the bottom is formed and the lateral wall 101 of the container semi finished (with the exclusion of the peripheral rim) by means of the drawing plate 15' with relative drawing matrix 15" of the counter drawing plate 14' with relative punch 14" as shown in FIG. 4*a*. At the same time where required, it will also be possible to make holes 24 in the bottom of the drawn container by means of punches 25 held, for example, by the upper drawing matrix 15". The configuration of the semi finished article in this stage of the operating cycle of the equipment is represented indicatively in FIG. 4*b*.

Figure 5A:
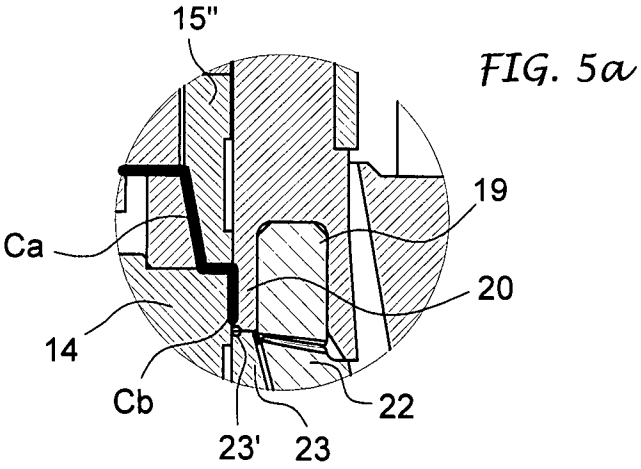
FIG. 5*a* shows an enlarged view of the circled detail in FIG. 5.
Figure 5B:
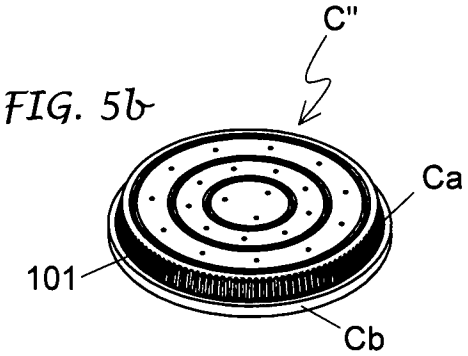
FIG. 5*b* shows a view of the container following the complete closure of the mould.
Figure 5:
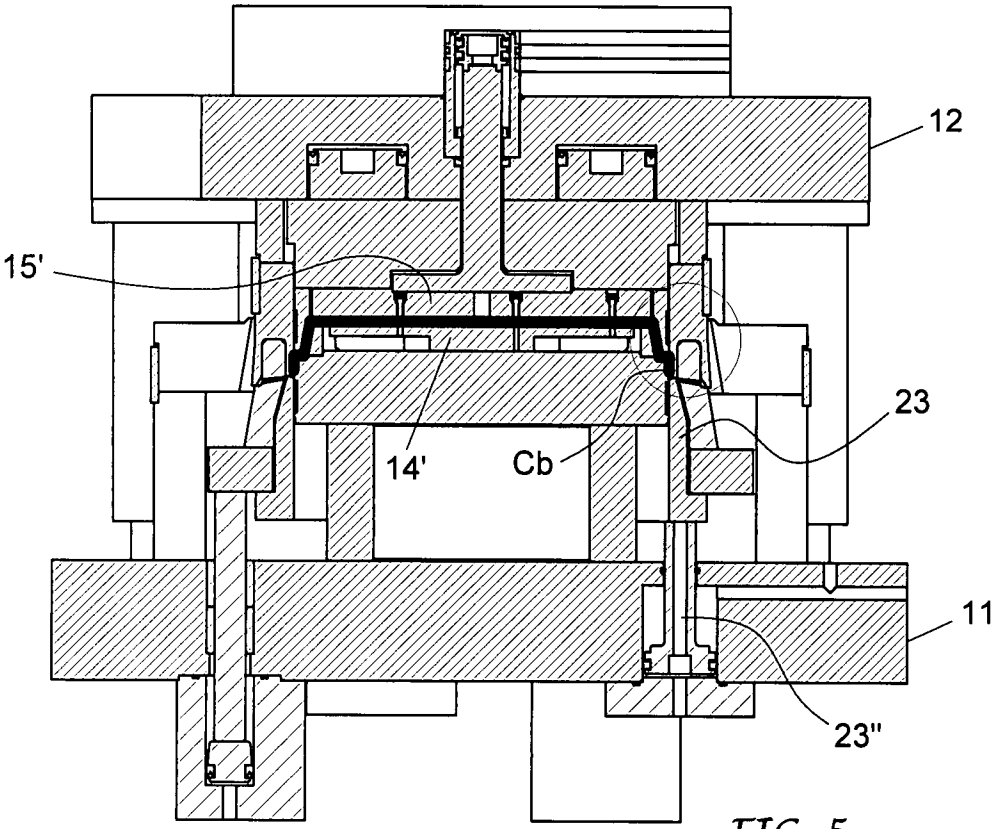
FIG. 5 shows a view of the equipment with mould in a complete closed position and ready for the formation of the peripheral rim of the container.

Then the closing of the mould is completed as shown in FIG. 5, causing in this way the pleating of the marginal portion Cb in a perpendicular direction to the bottom of the semi finished funnel, and furthermore the conclusion also of the pleating of this part of the margin, which then settles between the internal part of the upper rim former 20 and the opposite part of the lower semi-mould as shown in FIG. 5*a*. The semi finished article is then as is shown in FIG. 5*b*. and is heated in the area between the two semi-moulds.

It should be observed that in its final part the closing stroke of the mould can be temporarily slowed down or stopped until the humid paper is dry and until it hardens, establishing the shape of the semi-finished article.

Subsequently the opening movement of the mold and at the same time a movement of the counter rim former 23 start in relation to the upper rim former 20 and consequently in regards to the marginal portion Cb previously folded. Thus, while the semi finished article still remains held between the bottom and top components of the semi-molds—FIG. 6*a*, thanks to said two combined movements and to the groove of the counter former 23 the marginal portion Cb is obliged to curl inwards forming a basically toric rim 102 around the lateral wall 101 of the required container 100 and consequently finishing the latter.

Figure 7:
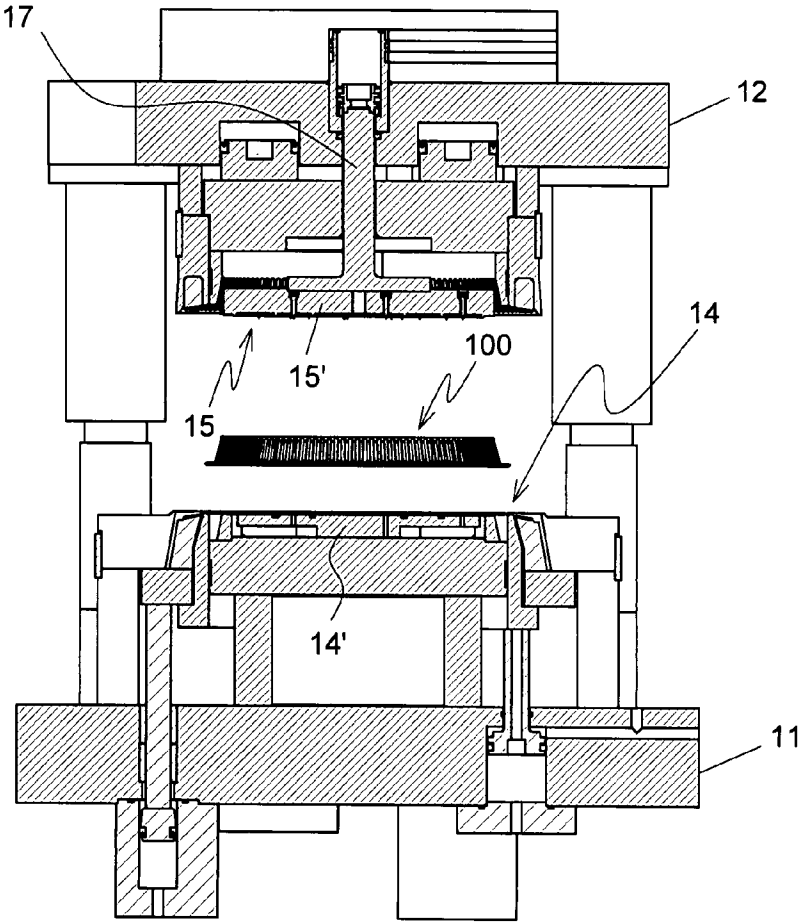
FIG. 7 shows a view of the equipment with mould in the complete re-opened position and ejection of the finished container.

The mould finally reaches the fully open position, in which the finished container 100 is released and expelled from the mould by a forward movement r of the drawing plate 15' of the upper semi-mould 15 as shown in FIG. 7, restoring the conditions in FIG. 1 for the start of a new, successive operating cycle.

FIG. 6*b* shows the resulting container, complete with peripheral rim, therefore finished, achieved according to the invention in a single blow at each opening and closing operating cycle of a mould.

The invention claimed is:

1. Equipment for forming paper containers in the shape of trays or tubs starting from a strip of wetted paper, where each container has a bottom, a pleated lateral wall and a curled peripheral rim, the equipment comprising:

a fixed semi-mold holder table with a fixed semi-mold;

a mobile semi-mold holder table with a semi-mold movable with respect to said fixed table from an open position to a closed position, said mobile semi-mold and said fixed semi-mold forming an impression corresponding to the container to be formed by a drawing process when said mobile semi-mold is in the closed position, wherein an upper cutting blade, an upper pleating/crimping ring and an upper rim former are provided concentrically around said mobile semi-mold, said fixed semi-mold being provided with a counter cutting blade, a counter upper pleating/crimping ring and a counter rim former, respectively associated with said upper cutting blade, said upper pleating/crimping ring and said upper rim former associated with said mobile semi-mold, said upper cutting blade and said counter cutting blade being provided to cut from the paper strip a length of blank paper depending on the dimensions of the container to be formed, said upper pleating/crimping ring and said counter upper pleating/crimping ring being designed to pleat/crimp a peripheral crown of said blank paper during a closing stroke of mobile semi-mold, said upper rim former and said counter rim former being provided to form a crimped rim around the lateral wall of the container during an opening stroke of said mobile semi-mold, wherein said upper cutting blade, said upper pleating/crimping ring and said upper rim former on one side, and correspondingly said counter cutting blade, said counter pleating/crimping ring and said counter rim former are in radial order from the outside to the inside and at different levels.

2. Equipment according to claim 1, wherein said fixed semi-mold comprises a lower drawing plate surrounded by a drawing punch, said mobile semi-mold comprising an upper drawing plate surrounded by a drawing matrix, wherein the impression corresponding to the container to be made is defined by said upper drawing plate and said lower drawing plate with said drawing matrix and said drawing punch.

3. Equipment according to claim 2, wherein said upper drawing plate of said mobile semi-mold is movable axially with regard to drawing matrix by means of a pneumatic thruster to expel the finished container from said mobile semi-mold.

4. Equipment according to claim 2, wherein said drawing plate of said mobile semi-mold is equipped with one or more piercing punches for making holes in the bottom of the container when the container is being drawn.

5. Equipment according to claim 1, wherein said counter rim former is movable together with said upper rim former and said counter rim has a rounded groove facing towards said upper rim former and said counter rim is designed to crimp an outer part of the paper blank after the paper blank has been drawn so as to form a substantially toric rim around a resulting wall of the container.

6. Equipment according to claim 1, wherein said upper cutting blade and said rim former associated with said mobile semi-mold are parts of one piece and said upper pleating/crimping ring is positioned between said upper cutting blade and said upper rim former, said upper pleating/crimping ring, said upper cutting blade and said upper rim former move together with said mobile semi-mold, whereby said upper cutting blade, said upper rim former and said upper pleating/crimping ring move based on movement of said mobile semi-mold, said upper rim former being in a fixed position with respect to said upper pleating/crimping ring and said upper cutting blade.

7. Equipment according to claim 1, wherein at least some parts of said fixed semi-mold and said mobile semi-mold are heated.

8. Equipment according to claim 1, wherein said upper cutting blade is located radially adjacent to said upper pleating/crimping ring with respect to a longitudinal axis of said mobile semi-mold holder table, said upper pleating/crimping ring being located radially adjacent to said upper rim former with respect to said longitudinal axis.

9. Equipment according to claim 8, wherein said counter cutting blade is located radially adjacent to said counter pleating/crimping ring with respect to a longitudinal axis of said fixed table, said counter pleating/crimping ring being located radially adjacent to said counter rim former with respect to said longitudinal axis of said fixed table.

10. Equipment according to claim 9, wherein said counter pleating/crimping ring engages one portion of said paper strip and said upper pleating/crimping ring engages another portion of said paper strip.

11. Equipment according to claim 8, wherein said upper pleating/crimping ring is located between said upper cutting blade and said upper rim former.

12. A method for forming paper containers with a bottom, a pleated lateral wall and a peripheral crimped rim, starting from a wetted paper strip and the use of two semi-molds susceptible of opening and closing strokes and defining at least an impression corresponding to the container to be made, the method comprising the steps of:

providing an upper cutting blade, an upper pleating/crimping ring and an upper rim former, said upper cutting blade, said upper pleating/crimping ring and said upper rim former being associated with one of the two semi-molds;

providing a counter cutting blade, a counter pleating/crimping ring and a counter rim former, said counter cutting blade, said counter pleating/crimping ring and said counter rim former being associated with another one of the two semi-molds, wherein said upper cutting blade, said upper pleating/crimping ring and said upper rim former on one side, and correspondingly said counter cutting blade, said counter pleating/crimping ring and said counter rim former are in radial order from the outside to the inside and at different levels;

feeding a length of starting paper strip between the two semi-molds when open;

starting the closing stroke of the two semi-molds;

cutting said length of paper with said upper cutting blade and said counter cutting blade from at least one blank paper corresponding to the development of the container to be produced to form a cut paper blank after an initial part of the closing stroke of the semi-molds;

pleating/crimping of a peripheral portion of said cut paper blank with said upper pleating/crimping ring and said counter pleating/crimping ring after a second part of the closing stroke of the semi-molds;

drawing of the blank paper to shape the bottom and the lateral wall of a semi-finished drawn piece except for the peripheral rim after a following part of the closing stroke of said semi-molds, said lateral wall being formed by at least a part of the peripheral pleated/crimped portion;

completing the closing stroke of the semi-molds to form a semi-finished drawn piece;

establishing a bend in a marginal part of said peripheral portion in a perpendicular direction to the bottom of the semi-finished drawn piece, completing the pleating/crimping of said marginal part, and consolidating the semi-finished drawn piece;

starting the opening stroke of the semi-molds and, during a part of the opening stroke, curling said marginal perpendicular part at the bottom of the semi-finished drawn piece with said upper rim former and said counter rim former to form a substantially toric rim around the lateral wall and termination of the required container;

releasing the finished container at the end of the opening stroke of the semi-molds.

13. A method according to claim 12, wherein the closing stroke of the semi-molds is slowed down or momentarily stopped during a final part thereof and the semi-finished drawn piece is heated to dry the wetted paper and to set the shape of the semi-finished drawn piece, the heating of the semi-finished piece being carried out through said semi-molds.

14. A method according to claim 12, wherein said upper cutting blade is located radially adjacent to said upper pleating/crimping ring with respect to a longitudinal axis of said one of the two semi-molds, said upper pleating/crimping ring being located radially adjacent to said upper rim former with respect to said longitudinal axis.

15. A method according to claim 14, wherein said counter cutting blade is located radially adjacent to said counter pleating/crimping ring with respect to a longitudinal axis of the another one of the two semi-molds, said counter pleating/crimping ring being located radially adjacent to said counter rim former with respect to said longitudinal axis of the another one of the two semi-molds.

16. A method according to claim 15, wherein said counter pleating/crimping ring engages one portion of said paper and said upper pleating/crimping ring engages another portion of said paper.

17. A method according to claim 14, wherein said upper pleating/crimping ring is located between said upper cutting blade and said upper rim former.

18. Equipment for forming paper containers, where each container has a bottom, a pleated lateral wall and a curled peripheral rim, the equipment comprising:

a fixed semi-mold holder table comprising a fixed semi-mold, said fixed semi-mold comprising a fixed semi-mold longitudinal axis;

a mobile semi-mold holder table comprising a semi-mold movable with respect to said fixed table from an open position to a closed position, said mobile semi-mold comprising a mobile semi-mold longitudinal axis, said mobile semi-mold and said fixed semi-mold forming an impression corresponding to a container to be formed by a drawing process when said mobile semi-mold is in the closed position;

an upper cutting blade associated with said mobile semi-mold, said upper cutting blade having a paper engaging upper cutting blade surface;

an upper pleating/crimping ring associated with said mobile semi-mold, said upper pleating/crimping ring having a paper engaging upper pleating/crimping ring surface;

an upper rim former associated with said mobile semi-mold, said upper rim former being movable based on movement of said mobile semi-mold, said upper rim former having a paper engaging upper rim former surface, said upper cutting blade, said upper pleating crimping ring and said upper rim former being provided concentrically about said mobile semi-mold;

a counter cutting blade associated with said fixed semi-mold, said counter cutting blade having a paper engaging counter cutting blade surface;

a counter pleating/crimping ring associated with said fixed semi-mold, said counter upper pleating/crimping ring having a paper engaging counter pleating/crimping ring surface;

a counter rim former associated with said fixed semi-mold, said counter rim former having a paper engaging counter rim former surface, said upper cutting blade and said counter cutting blade being provided to cut a length of blank paper from a paper strip, said upper pleating/crimping ring and said counter pleating/crimping ring forming a peripheral crown of the blank paper during a closing stroke of said mobile semi-mold, said upper rim former and said counter rim former forming a crimped rim about the lateral wall of the container during an opening stroke of said mobile semi-mold, said upper cutting blade being located at a first radial distance from said mobile semi-mold longitudinal axis, said upper pleating crimping ring being located at a second radial distance from said mobile semi-mold longitudinal axis, said upper rim former being located at a third radial distance from said mobile semi-mold longitudinal axis, said first radial distance being greater than said second radial distance, said second radial distance being greater than said third radial distance, said third radial distance being less than said first radial distance and said second radial distance, each of said paper engaging upper cutting blade surface, said paper engaging upper pleating/crimping ring surface and said paper engaging upper rim former surface being located at a different axial position with respect to said mobile semi-mold longitudinal axis, said counter cutting blade being located at one radial distance from said fixed semi-mold longitudinal axis, said counter pleating/crimping ring being located at another radial distance from said fixed semi-mold longitudinal axis, said counter rim being located at yet another radial distance from said fixed semi-mold longitudinal axis, said one radial distance being greater than said another radial distance, said another radial distance being greater than said yet another radial distance, said yet another radial distance being less than said one radial distance and said another radial distance, each of said paper engaging counter cutting blade surface, said paper engaging counter pleating/crimping ring surface and said paper engaging counter rim former surface being located at a different axial position with respect to said fixed semi-mold longitudinal axis.

19. Equipment according to claim 18, wherein each of said paper engaging upper cutting blade surface, said paper engaging upper pleating/crimping ring surface, said paper engaging upper rim former surface, said paper engaging counter cutting blade surface, said paper engaging counter pleating/crimping ring surface and said paper engaging counter rim former surface engages a different surface of the paper, said upper cutting blade, said upper pleating/crimping ring and said upper rim former being linked with one another to form at least one cutting, pleating/crimping and rim forming unit, said at least one cutting, pleating/crimping and rim forming unit being movable in a direction of said fixed semi-mold holder table based on movement of said mobile semi-mold.

20. Equipment according to claim 19, wherein said upper cutting blade is located radially adjacent to said upper pleating/crimping ring with respect to said mobile semi-mold longitudinal axis, said upper pleating/crimping ring being located radially adjacent to said upper rim former with respect to said mobile semi-mold longitudinal axis, wherein said upper cutting blade, said upper pleating/crimping ring and said upper rim former are in fixed positions relative to each other, said counter cutting blade being located radially adjacent to said counter pleating/crimping ring with respect to said fixed semi-mold longitudinal axis, said counter pleating/crimping ring being located radially adjacent to said counter rim former with respect to said fixed semi-mold longitudinal axis.

* * * * *